US006280639B1

(12) United States Patent
Ortiz

(10) Patent No.: US 6,280,639 B1
(45) Date of Patent: Aug. 28, 2001

(54) METHOD AND APPARATUS FOR AUTOMATIC CLEANING OF A SWIMMING POOL

(76) Inventor: Pedro G. Ortiz, 1402 Vargas Rd., Austin, TX (US) 78741

( * ) Notice: Subject to any disclaimer, the term of this patent is extended or adjusted under 35 U.S.C. 154(b) by 0 days.

(21) Appl. No.: 09/597,204

(22) Filed: Jun. 20, 2000

(51) Int. Cl.[7] ..... E04H 4/16

(52) U.S. Cl. ..... 210/776; 210/169; 210/322; 210/416.2; 4/492; 15/1.7; 134/24; 134/167 R

(58) Field of Search ..... 210/169, 322, 210/416.2, 776; 4/490, 492, 507, 509; 15/1.7; 134/10, 24, 109, 110, 166 R, 167 R

(56) References Cited

U.S. PATENT DOCUMENTS 2,617,764 * 11/1952 Hauber et al. .
3,018,491 * 1/1962 Read .
3,486,623 * 12/1969 Bosico .
3,506,489 * 4/1970 Baker .
3,521,304 * 7/1970 Ghiz .
3,675,252 * 7/1972 Ghiz .
4,640,784 * 2/1987 Cant .
4,907,610 * 3/1990 Meincke .
5,107,872 * 4/1992 Meincke .
5,135,579 * 8/1992 Goettl .
6,022,481 * 2/2000 Blake .

* cited by examiner

*Primary Examiner*—Chester T. Barry
*Assistant Examiner*—Fred Prince
(74) *Attorney, Agent, or Firm*—Rick B. Yeager

(57) ABSTRACT

A self-cleaning swimming pool with an improved skimmer and floor drain design. Two skimmers are preferably located approximately across the pool from each other, and each skimmer is located approximately across the pool from two upper return nozzles such that the nozzles tend to direct a flow of water toward the skimmers. A plurality of capped floor drains are located preferably not more than twelve feet apart or more than six feet from each pool end; and a plurality of lower return nozzles are preferably located 6 to 12 inches from the pool bottom to direct debris on the pool bottom towards the floor drains.

17 Claims, 6 Drawing Sheets

METHOD AND APPARATUS FOR AUTOMATIC CLEANING OF A SWIMMING POOL

FIELD OF THE INVENTION

The present invention relates to a novel design for placement of swimming pool drains and return inlets which permits a unique self-cleaning of debris from the bottom and side walls of the pool.

BACKGROUND

The primary purpose of the present invention is to provide an improved automatic swimming pool cleaning system to remove accumulated debris and sediment from the inner surface of various swimming pools. There have been many attempts by prior art to solve the problem of designing a self cleaning swimming pool system. The superiority of the present invention is to provide an improved automatic swimming pool cleaning system, which is relatively uncomplicated and inexpensive to construct and which provides a more efficient method for cleaning the inner surface of a swimming pool.

The unexpected and inventive aspect of the current method and apparatus is based on the observation that deliberate placement of multiple outlet drains on a pool bottom, when combined with a distribution of the return water from the circulation pump to the lower portion of pool side walls promotes an effective removal of debris from a pool bottom without the requirement of random sweeping devices and the like. An important concept of the invention is to provide a combination of placement of return inlets distributed along the pool walls near the bottom of the pool and to provide multiple drains on the pool bottom. In addition to removing debris, the method and apparatus improves the pool safety by lowering the suction force from each drain, thereby decreasing the chances that a swimmer will be stuck by suction to the bottom of the pool. An additional benefit is the ability to use another drain intake if one becomes clogged by very large debris.

There are two main types of prior art cleaning systems. The first type includes methods of agitating the debris and sediment by means of a hose, which dislodges the debris by actual contact, or by creating water turbulence. Examples of this approach are U.S. Pat. Nos. 3,032,044 and 2,975,791 both by Pansini; U.S. Pat. No. 3,261,371 by Vernon; U.S. Pat. No. 2,919,027 by Blumenfeld; and U.S. Pat. No. 4,282,893 by Kane. One problem with these methods is that, alone, they do not provide a systematic method for the removal of the sediment and debris once it has been made mobile. In addition, these methods require expensive and complicated equipment.

The second approach includes methods of dislodging dirt and debris by means of jets affixed to the floor of the pool. Examples of this approach are U.S. Pat. No. 3,521,304 by Ghiz; U.S. Pat. Nos. 4,520,514; 4,114,206 by Franc; U.S. Pat. No. 5,135,579 by Goettl; U.S. Pat. No. 3,045,829; 3,506,489 by Baker; and U.S. Pat. No. 4,640,784 by Cant. The problems with this approach includes the requirement of expensive and complicated equipment; and that the design typically provides only a single bottom drain. The single bottom drain requires excess complexities on the jets to provide a very limited cleaning stream due to other currents occurring in the water caused by factors such as swimmers, wind, and water pressure.

An object of the current invention is to provide a self cleaning capability for removing debris from the bottom of a swimming pool through the placement of multiple return jets and multiple bottom drains.

An additional object of the current invention is to eliminate or reduce the requirement for pool bottom sweepers and pool cleaning services.

Another object of the current invention is to improve the safety of a pool by reducing drain suction pressure and by providing multiple drains in the event that a swimmer does get caught in a drain.

SUMMARY OF THE INVENTION

One basis of the current invention is the observation that debris may be removed from the bottom of a pool through a bottom drain, even if the slope to that drain is relatively shallow. The debris removing capability is improved dramatically when a capped drain is used so that water enters the drain essentially parallel to the floor. By carefully placing a plurality of capped floor drains in the pool floor, it is possible to provide effective debris removal capability across the entire pool floor.

The cleaning effect of the multiple capped floor drain pool is further improved by causing the recirculation inlet water to be introduced at multiple locations along the circumference of the pool on the lower portions of the pool walls. The circulation between these multiple lower wall inlets and multiple capped floor drains creates a surprising cleaning effect on the pool bottom.

The invention applies to new swimming pools and to retrofitting existing pools.

DESCRIPTION OF EMBODIMENT—POOLS 25 TO 36 FEET IN LENGTH

Figure 1:
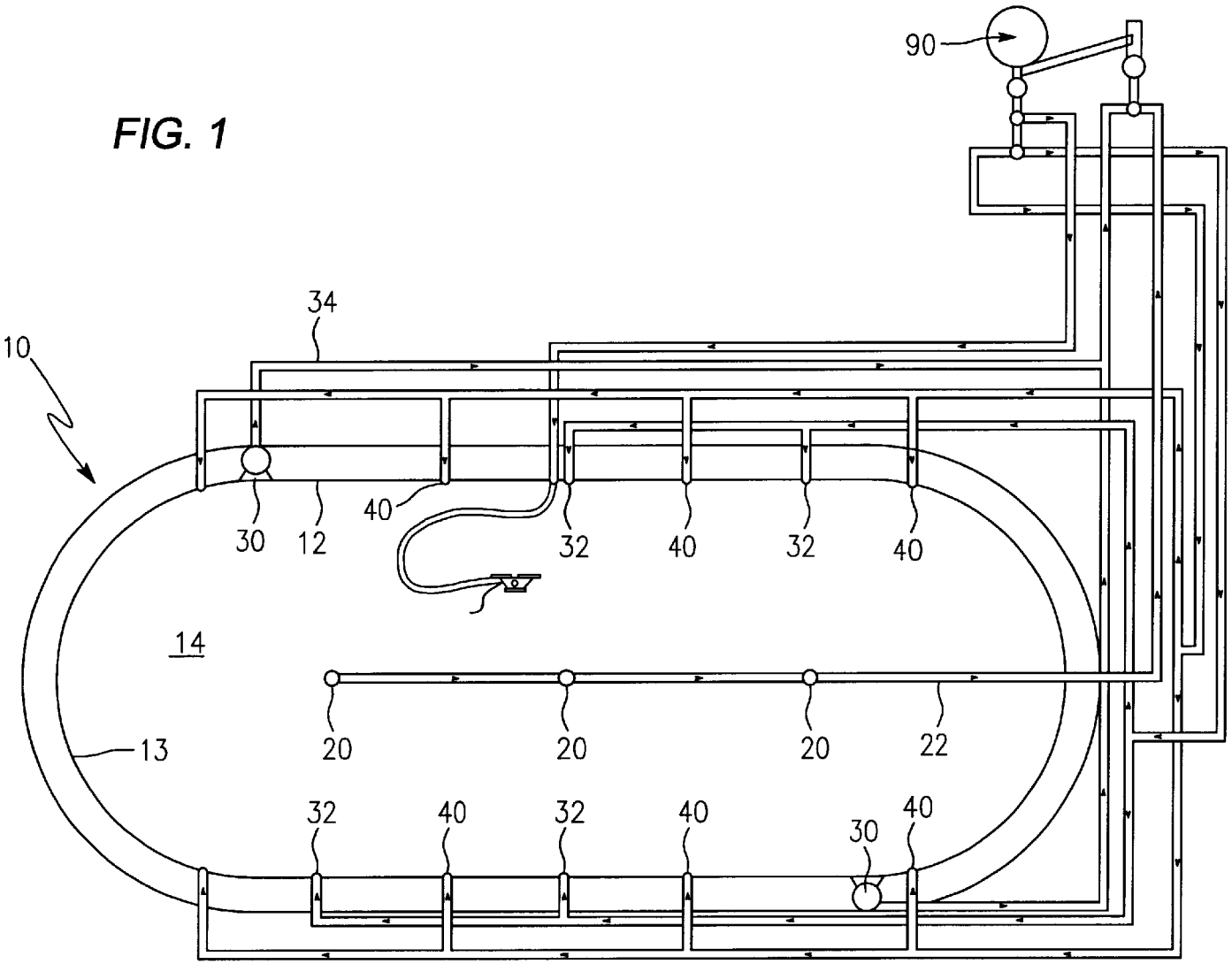
FIG. 1 is a top view piping schematic for a typical pool showing multiple inlets and multiple floor drain locations.

Referring to FIG. 1, which is a top view of an embodiment of the swimming pool cleaning system, the cleaning system includes a water filled swimming pool structure 10. The pool is preferably an oval shape, but may be designed into other shapes as well. The pool further has defined inner surfaces which include side walls 12, end walls 13., and a floor 14.

Multiple drain intakes 20 are located along the pool floor. The proximity of the drain intakes is relative to the size and shape of the pool. They are preferably positioned no more than 10 feet away from each other and no more than 5 feet from the end walls 13, although the spacing may be increased to 12 feet away from each other and 6 feet from the end walls. The preferred number of drains in a pool of 25 to 36 feet in length is three drains.

The pool is designed for circulation and filtration through a single circulation pump. One benefit of the design is to reduce pool chemical consumption. All of the drain intakes are connected by a lower intake line 22 which runs longitudinally inside the shell of the pool and then to the filtration equipment 90. The oval-shaped pool is the simplest design, and can generally be serviced with a single lower intake line. In the event that kidney-shaped or other shapes of pools are designed, the drain intake main may include branch lines to access portions of the pool.

In this embodiment, a portion of the recirculation water is drawn from the bottom drains 20, and a portion is drawn from the skimmers 30. The preferred skimmer design is to include at least two skimmers located essentially opposite of each other and located with consideration as to which way prevailing winds are likely to push floating debris. For instance if the prevailing wind is from the southwest, one skimmer would be located at approximately the northeast corner of the pool, and the other skimmer would be located at the southwest corner of the pool.

The recirculation return lines are preferably split into two streams, with one stream delivering water to upper jets 32 located essentially across the pool from the skimmers, and to lower jets 40 located on the lower portions of the pool walls approximately midway between each pair of drains or between the end drain and the end wall.

Figure 2:
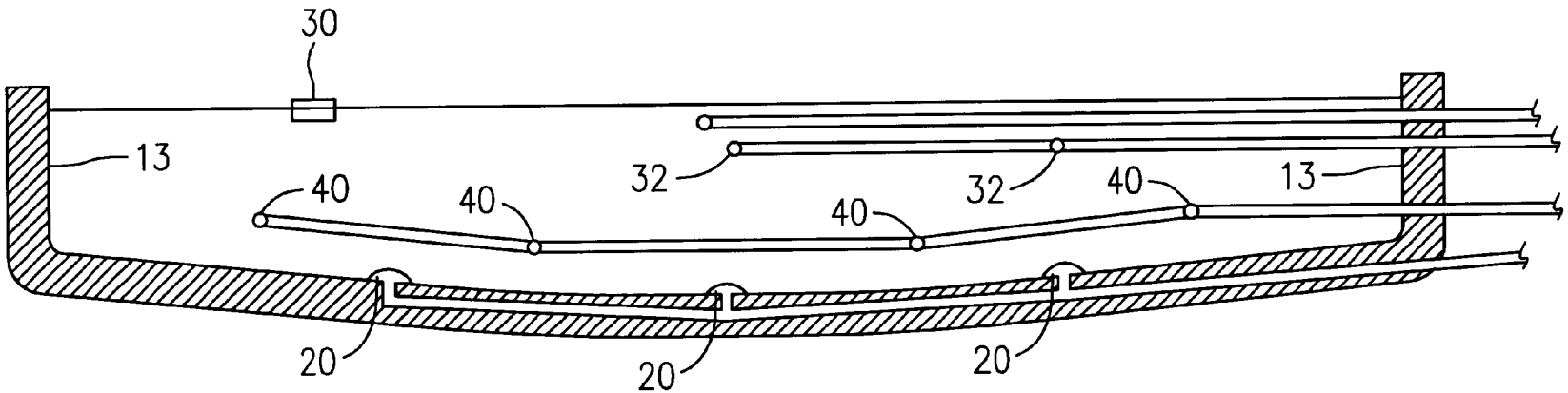
FIG. 2 is a side cross section view of a typical pool showing multiple inlets and multiple floor drain locations.

Referring now to FIG. 2, which is a side cross-sectional view of the preferred embodiment of the swimming pool cleaning system, the level of the water surface 11 is approximately located at the center of the skimmer intake 30.

Figure 3:
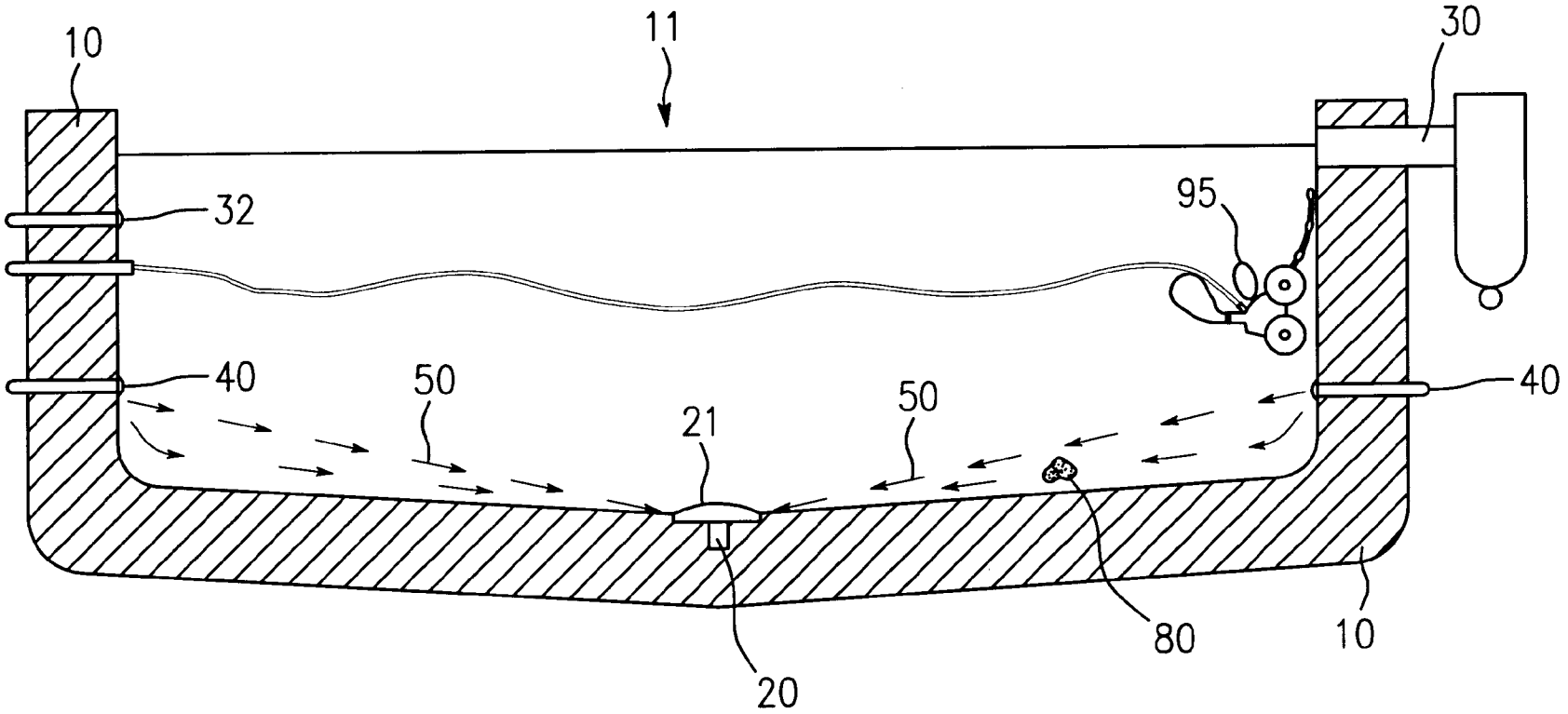
FIG. 3 is an end cross section view piping schematic for a typical pool showing inlets, a capped drain, and the flow of debris across the pool floor.

Referring now to FIG. 3, which is an end cross-sectional view of the preferred embodiment, the preferred cover 21 for the drain intakes 20 are to be made with openings to the outer annulus only, such as the Anti-Vortex main drain available from Hayward Products Inc. A portion of the return water flows from the lower jets 40 along the pool bottom, thereby pushing debris 80 toward the drain 20.

The present cleaning system calls for the horsepower of the pump to be equal to or larger than the combined number of upper and lower inlets multiplied by ¼ horsepower. In this embodiment, a 350–400 square foot surface area oval-shaped pool has 3 floor drains, a 3 horsepower pump with 12 returns, thereby allowing ¼ horsepower of pump capacity for each return as described in the example below.

Conventional skimmers are typically located in a north-south orientation, and are preferably located across from each other. In the event that there are numerous trees at the location, then additional skimmers may be used.

The preferred drain size is a 1½ inch main drain and a 2" diameter drain line. In order to minimize clogging of the drain lines, the drains are capped and drilled to a 1" opening so that anything that clears the opening should continue down the drain and the main line without causing an obstruction.

The return line preferably includes a two-way valve to permit adjustment to direct more return to the top of the pool to assist in leave removal.

In the event that a Polaris™-type cleaner is used, a three way valve is used to direct a portion of the flow to that device. If a Polaris is used, it is preferably programmed for 4 hours of operation in the morning.

The return line consists of 1½ inch PVC piping which is reduced to ½" eyeball -type jets at the pool wall. The jets are preferably located 6–12 inches above the pool floor and positioned so that each opposite side wall has a jet approximately halfway between the floor drains and halfway between the floor drain and the end wall. The jets may be located anywhere in a range of approximately 0–14 inches above the floor of the pool.

The pump typically provides a 1.5 to 2 hour turnover time for the pool volume. The preferable run time is 4 hours in the morning and 4 hours in the evening.

FIGS. 4, 6, 7, 8,9, 10, 11, 12, 13, and 15 illustrate the general concept of floor drain and lower return layout for various shapes of pools. These figures are not an exhaustive description of all possible pool configurations, and one skilled in the art can apply the design considerations to pools of other configurations. The examples below illustrate how these design considerations are applied in specific circumstances.

EXAMPLE 1

30 Foot Oval Pool Oriented East-West

Three (3) floor drains are located the pool bottom centerline at approximately 5, 15, and 25 feet from East end.

Four (4) lower returns are located on North wall at 6–12 inches above pool bottom at approximately 2.5, 10, 20 and 27.5 feet from East end.

Four (4) lower returns are located on South wall at 6–12 inches above pool bottom at approximately 2.5, 10, 20 and 27.5 feet from East end.

A first skimmer is located on North wall about 26 feet from East end.

There are two (2) upper returns located across from the first skimmer on the South wall at approximately 15 and 25 feet from East wall.

A second skimmer is located located on South wall about 4 feet from East end.

There are two (2) upper returns located across from the second skimmer on the North wall at approximately 5 and 15 feet from East wall.

EXAMPLE 2

36 Foot Oval Pool oriented East-West

There are three (3) floor drains located along the pool bottom centerline at approximately 6, 18, and 30 feet from East end.

There are four (4) lower returns located on the North wall at 6–12 inches above pool bottom at approximately 3, 12, 24, and 33 feet from East end.

There are four (4) lower returns located on South wall at 6–12 inches above pool bottom at approximately 3, 12, 24, and 33 feet from East end.

A first skimmer is located on North wall about 32 feet from East end.

There are two (2) upper returns located across from the first skimmer on the South wall at approximately 21 and 31 feet from East wall.

A second skimmer is located on South wall about 4 feet from East end.

There are two (2) upper returns located across from the second skimmer on the North wall at approximately 5 and 15 feet from East wall.

DESCRIPTION OF EMBODIMENT-POOLS LESS THAN 25 FEET

Figure 5:
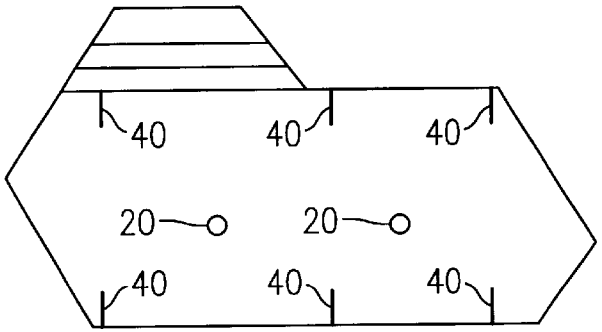
FIG. 5 is a top view of an alternate shorter pool shape with drain and return layout.
Figure 7:
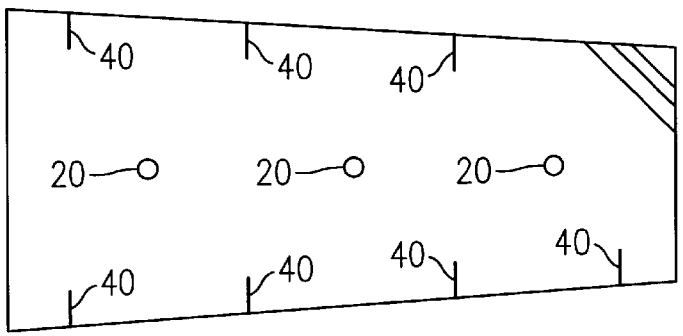
FIG. 7 is a top view of an alternate pool shape with drain and return layout.
Figure 4:
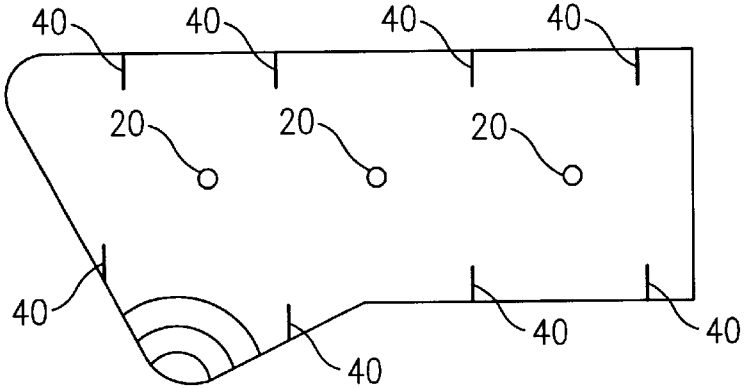
FIG. 4 is a top view of an alternate pool shape with drain and return layout.
Figure 6:
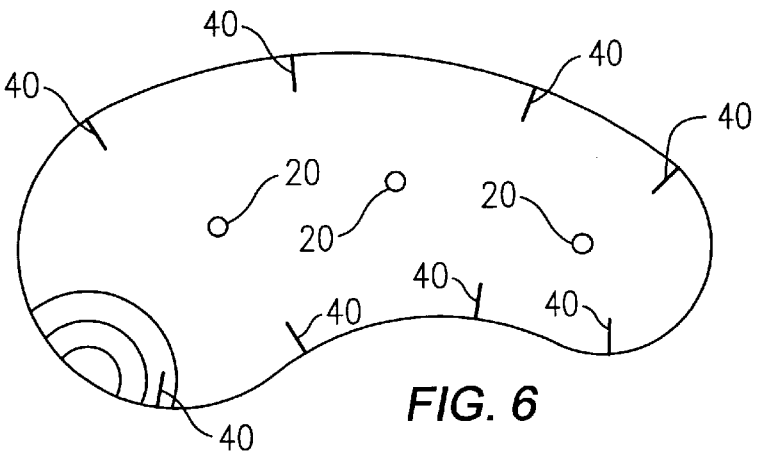
FIG. 6 is a top view of an alternate pool shape with drain and return layout.
Figure 9:
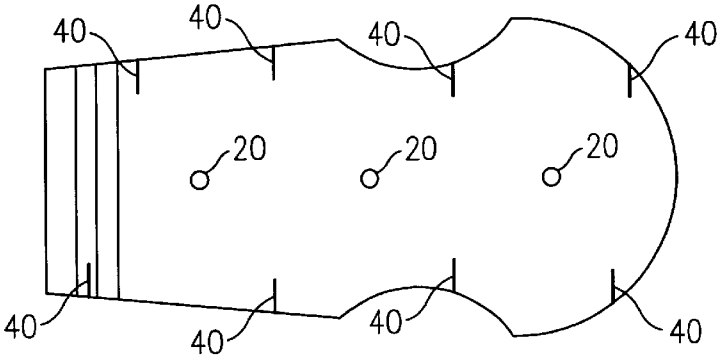
FIG. 9 is a top view of an alternate pool shape with drain and return layout.
Figure 11:
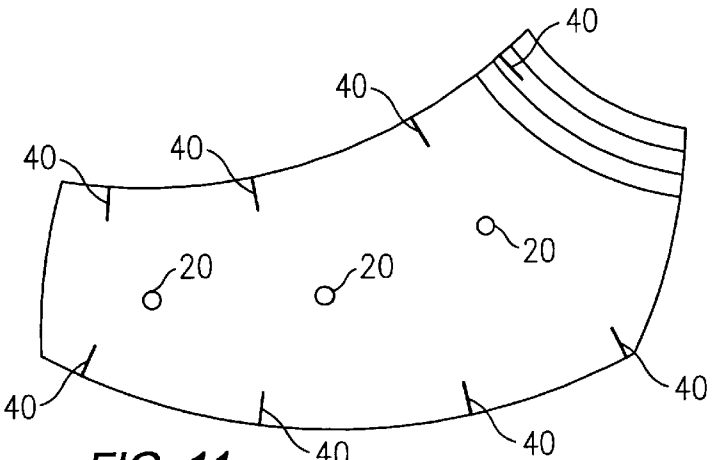
FIG. 11 is a top view of an alternate pool shape with drain and return layout.
Figure 8:
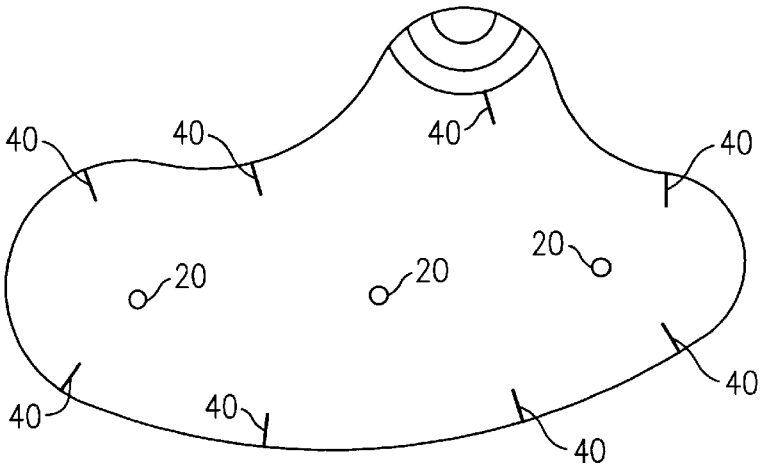
FIG. 8 is a top view of an alternate pool shape with drain and return layout.
Figure 10:
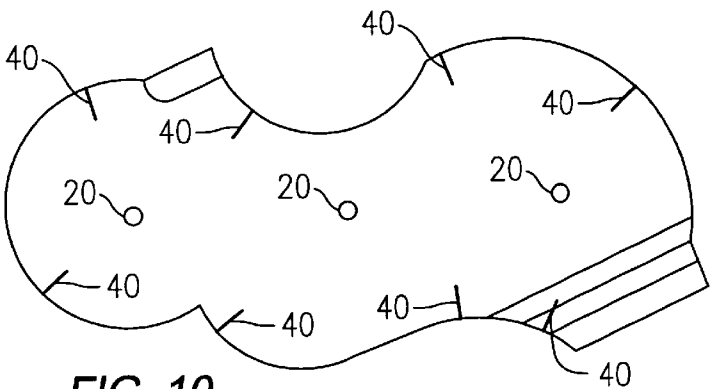
FIG. 10 is a top view of an alternate pool shape with drain and return layout.
Figure 12:
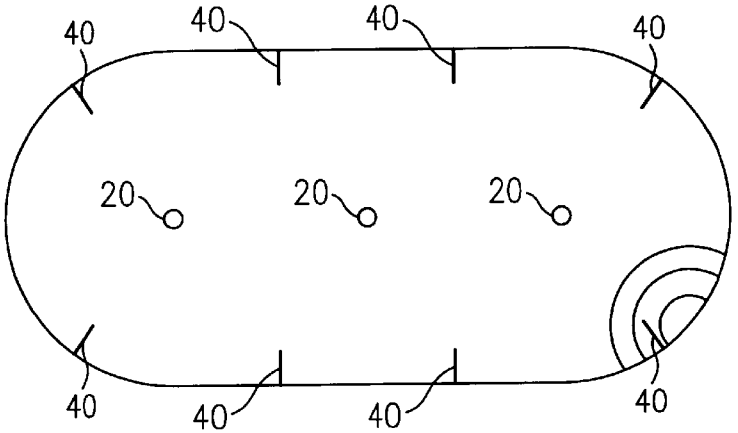
FIG. 12 is a top view of an alternate pool shape with drain and return layout.
Figure 13:
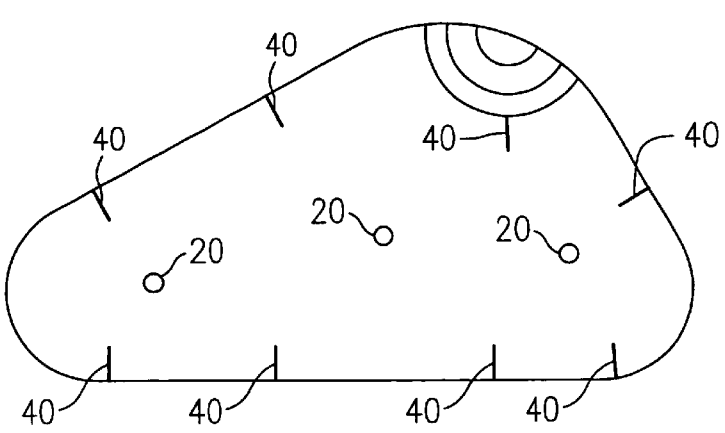
FIG. 13 is a top view of an alternate pool shape with drain and return layout.

Referring now to FIG. 5, for pools less than 25 feet in length, normally only two floor drains are required. The drains are preferably positioned no more than 6 feet from the end walls and no more than twelve feet from each other. Pools less than 25 feet normally have only three lower returns on each of the two side walls. The skimmers and upper returns are placed in similar positions but are spaced proportional to pool length.

Figure 14:
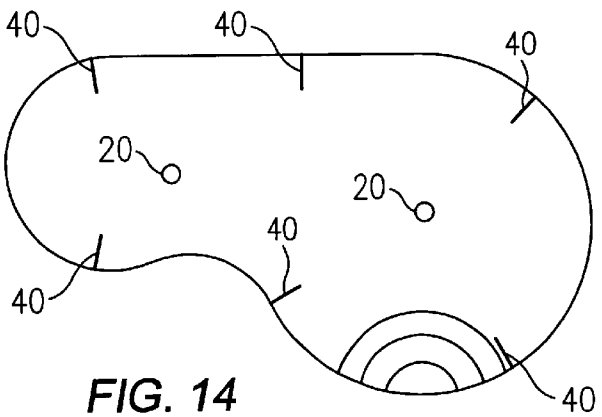
FIG. 14 is a top view of an alternate shorter pool shape with drain and return layout.
Figure 15:
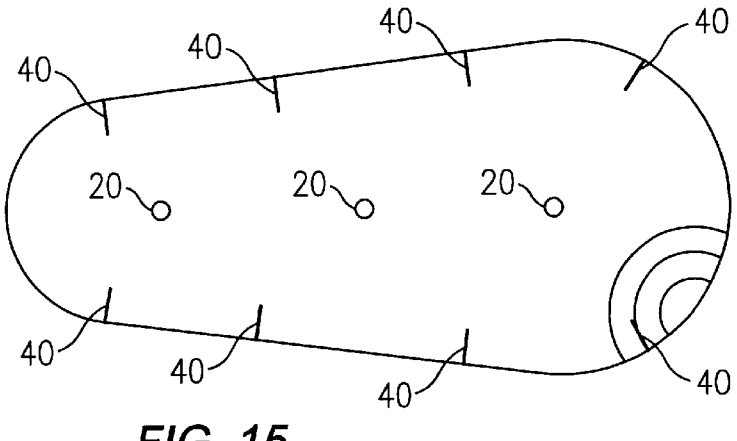
FIG. 15 is a top view of an alternate pool shape with drain and return layout.

FIG. 14 illustrates an alternate pool shape. These figures are not an exhaustive description of all possible pool configurations, and one skilled in the art can apply the design considerations to pools of other configurations. The example below illustrate how these design considerations are applied in a specific circumstance.

EXAMPLE 3

22 Foot Oval Pool Oriented East—West

There are two (2) floor drains located along pool bottom centerline at approximately 6, and 16 feet from East end.

There are three (3) lower returns located on the North wall at 6–12 inches above pool bottom at approximately 3, 11, and 19 feet from the East end.

There are three (3) lower returns located on the South wall at 6–12 inches above pool bottom at approximately 3, 11, and 19 feet from the East end.

A first skimmer is located on the North wall at about 18 feet from the East end.

There are two (2) upper returns located across from the first skimmer on the South wall at approximately 17 and 13 feet from the East wall.

A second skimmer is located on South wall about four feet from East wall There are two (2) upper returns located across from the first skimmer on the North wall at approximately 5 and 9 feet from the East wall.

DESCRIPTION OF EMBODIMENT—POOLS GREATER THAN 36 FEET

For pools greater than 36 feet in length, the preferred layout is consistent with the smaller pools but proportional to the pool size. Additional floor drains are added to maintain a preferred 10 to 12 foot spacing between the drains. Each floor drain is positioned approximately halfway between a pair of lower return jets on each side wall. The skimmers and upper return jets are laid ut according to prevailing winds and site considerations as described above. For pools greater than 36 feet in length, a larger pump is needed to provide approximately ¼ HP per lower inlet.

EXAMPLE 4

40 foot oval pool Oriented East—West

There are four (4) floor drains located along pool bottom centerline at approximately 5, 15, 25, and 35 feet from the East end There are five (5) lower returns located on North wall at 6–12 inches above pool bottom at approximately 2.5, 10, 20,30, and 32.5 feet from the East end.

There are five (5) lower returns located on South wall at 6–12 inches above pool bottom at approximately 2.5, 10, 20,30, and 32.5 feet from the East end.

A first skimmer is located on the North wall about 36 feet from east end.

There are two (2) upper returns located across from the first skimmer on the South wall at approximately 35 and 25 feet from the East wall.

A second skimmer is located on the South wall about four feet from the East end.

There are two (2) upper returns located across from the second skimmer on the North wall at approximately 5 and 15 feet from the East wall.

DESCRIPTION OF EMBODIMENT-RETROFITTING EXISTING POOLS

This pool cleaning invention may be installed on an existing pool either at the time of other repair work on the pool, or as a special project.

Additional drains are added to the bottom of the pool, and tied into the existing main drain line. To cover the additional drain lines, it is desirable to pour about six inches of new concrete on top of the existing pool floor and new drain lines to cover the drains. Capped drains are then installed on the new drains as described in the embodiments above.

The additional bottom return inlets are preferably added by excavating outside the pools and drilling into the pool from the outside. After the new inlets are installed, the area around each inlet is patched. The return lines are then plumbed to the pump.

New plaster is then added to the bottom and sides of the pool to complete the retrofit.

In some cases, depending upon the location and leaf maintenance history of the pool it may be desirable to add a second skimmer.

What is claimed is:

1. A swimming pool with a self bottom cleaning capability, the pool comprised of:

a swimming pool having a first side wall and a second side wall, end walls, and a floor;

at least one skimmer means, an upper circulation return means;

a plurality of floor drains which are each capped so as to force water to enter the drains approximately parallel to the pool floor;

a lower circulation return means with a plurality of lower return jets, such that a portion of the lower return jets are located along the lower portion of the first side wall, and a portion of the lower return jets are located along the lower portion of the second side wall; and a return circulation pump having at least approximately ¼ horsepower for each upper and lower return jet, such that the pump draws water from the skimmer means and floor drains and returns the water to the pool through the upper circulation return means and the lower return jets.

2. The pool of claim 1 wherein:

there are at least two skimmer means; and the upper circulation return means includes at least two upper return jets located approximately across the pool from each skimmer means.

3. The pool of claim 1 wherein:

the floor drains are located no more than twelve feet apart and such that a drain is located within six feet of each end wall.

4. The pool of claim 1 wherein:

the lower return jets are located within the range of zero to fourteen inches above the pool floor.

5. The pool of claim 4 wherein:

the lower return jets are located within the range of six to twelve inches above the pool floor.

6. The pool of claim 1 wherein:

there is at least one floor drain for each 100 to 150 square feet of pool bottom area.

7. The pool of claim 1 wherein:

the floor drains have an approximately 1 inch opening.

8. The pool of claim 1 wherein:

the lower return jets are ½ inch eyeball-type nozzles.

9. A swimming pool with a self cleaning capability, the pool comprised of a swimming pool having a first side wall and a second side wall, end walls, and a floor;

at least two skimmer means, an upper circulation return means; such that there are at least four upper return jets;

a plurality of capped floor drains such that water is forced to enter the drains approximately parallel to the pool floor, and such that the drains are located no more than twelve feet apart and such that a drain is located within six feet of each end wall;

a lower circulation return means with a plurality of lower return jets having ½ inch eyeball-type nozzles located six to twelve inches above the pool floor, such that a portion of the lower return jets are located along the lower portion of the first side wall, and a portion of the lower return jets are located along the lower portion of the second side wall; and a return circulation pump means having at least approximately ¼ horsepower for each upper and lower return jet, such that the pump draws water from the skimmer means and floor drains and returns the water to the pool through the upper circulation return means and the lower return jets.

10. A method of self cleaning a swimming pool, the method comprised of providing a plurality of capped floor drains such the floor drains drain water approximately parallel to the pool bottom;

providing a plurality of lower return jets, each jet located approximately 6–12 inches above the pool bottom at the location of the jet;

providing at least two skimmer means such that the skimmer means are approximately equally spaced along the periphery of the pool;

providing a plurality of upper return jets such that the upper jets are located approximately across the pool from the skimmer means;

providing a recirculation pump to supply the lower return jets and the upper return jets, the recirculation pump having approximately at least ¼ horsepower per each upper and lower return jet; and operating the recirculation pump approximately at least 8 hours per day.

11. The method of claim 10 comprising the additional steps of providing approximately ½ inch eyeball-type lower return jets;

providing a number of lower return jets equal to two more than twice the number of floor drains;

placing half of the lower return jets on a first side of the pool in a manner that places a return jet approximately halfway between each floor drain, and which places a return jet approximately halfway between each end floor drain and the nearest end wall; and placing the other half of the lower return jets on a second side of the pool, the second side being approximately opposite of the first side, in a manner that places a return jet approximately halfway between each floor drain, and which places a return jet approximately halfway between each end floor drain and the nearest end wall.

12. The method of claim 10 comprising the additional steps of providing two upper return jets for each skimmer means; and placing the two upper jets for each skimmer means approximately opposite of that skimmer means.

13. The method of claim 10 comprising the additional steps of placing the floor drains so that a drain is located approximately less than 6 feet from each wall and approximately 12 feet or less from an adjacent drain.

14. A method of installing a self cleaning system on an existing swimming pool, the method comprised of adding additional drain locations along the floor of the swimming pool such that a drain is located approximately less than 6 feet from each wall and approximately 12 feet or less from an adjacent drain;

adding a plurality of lower return jets, such that each jet is located approximately 6–12 inches above the pool bottom at the location of the jet;

plumbing the drain locations to a swimming pool re-circulation pump inlet line; and plumbing the lower return jets to the swimming pool re-circulation pump inlet line.

15. The method of claim 14 comprising the additional steps of plumbing the additional drain locations with new drainage pipe to the existing main drain pipe;

pouring approximately six inches of concrete on the bottom of the swimming pool, thereby covering the new drainage pipe; and providing a capped floor drain at each drain location such that the floor drains drain water approximately parallel to the pool bottom.

16. The method of claim 14 comprising the additional steps of providing a number of lower return jets equal to two more than twice the number of floor drains;

positioning half of the lower return jets on a first side of the pool in a manner that places a return jet approximately halfway between each floor drain, and which places a return jet approximately halfway between each end floor drain and the nearest end wall;

positioning the other half of the lower return jets on a second side of the pool, the second side being approximately opposite of the first side, in a manner that places a return jet approximately halfway between each floor drain, and which places a return jet approximately halfway between each end floor drain and the nearest end wall;

excavating along the outside pool wall at the location of each lower return inlet;

drilling through the pool wall at the location of each lower return inlet; and installing an approximately ½ inch eyeball-type lower return jet at the location of each lower return inlet.

17. The method of claim 14 comprising the additional steps of adding at least one additional skimmer to the swimming pool.

* * * * *